US005241751A

United States Patent [19]

Goh

[11] Patent Number: 5,241,751

[45] Date of Patent: Sep. 7, 1993

[54] WET RAZOR HAVING AIR-WASHING DEVICE

[76] Inventor: Kwang C. Goh, 5-dong 710, Samik Apt., 607, Songnae-dong, Nam-ku, Puchun, Kyongki-do, Rep. of Korea

[21] Appl. No.: 1,701

[22] Filed: Jan. 7, 1993

[30] Foreign Application Priority Data

Nov. 27, 1992 [KR] Rep. of Korea ..... 92-22538

[51] Int. Cl.[5] ..... B26B 19/44; B26B 19/40

[52] U.S. Cl. ..... 30/41.5; 30/41

[58] Field of Search ..... 30/41, 41, 5, 133, 47, 30/34.2, 45, 40, 47, 86

[56] References Cited

U.S. PATENT DOCUMENTS 4,633,585 1/1987 Whitaker et al. ..... 30/41
4,868,982 9/1989 McComas ..... 30/41
5,014,427 5/1991 Byrne ..... 30/41
5,029,390 7/1991 Reeves ..... 30/41

*Primary Examiner*—Frank T. Yost
*Assistant Examiner*—Paul M. Heyrana, Sr.
*Attorney, Agent, or Firm*—Lowe, Price, LeBlanc & Becker

[57] ABSTRACT

A wet blade razor includes improved means for removing shaving matter and drying the blades, comprising a device for completely removing shaving matter from between the double overlapping blades of the razor by incorporation of a piston therein. The piston includes a one way valve which permits air to be drawn through ducts formed in the piston. The air ducts enable the razor to use air pressure forced out of a plurality of air spray holes to create a plurality of bubbles in the water when the razor is immersed in water. The bubbles are forced against the shaving matter to dislodge shaving matter from the blade assembly.

3 Claims, 4 Drawing Sheets

WET RAZOR HAVING AIR-WASHING DEVICE

BACKGROUND OF THE INVENTION

1. Field of the Invention

The present invention relates to a double blade wet razor capable of removing shaving matter caught between the blades during use by producing a bubble, and more particularly to a wet razor which includes a device for completely removing shaving matter from between its double overlapping blades.

2. Information Disclosure Statement

Wet razors which use a pair of blades, i.e. stacked blades, to cut facial hair or whiskers from the skin are widely used. Many such shavers cannot be dissembled for cleaning. Shaving matter such as shaving foam, cut whiskers, flakes of skin, and the like, wedge between the upper and lower blades during the use of the razor. At present there is no integral device for removing such matter from the blades. Thus, the wet razor is usually dipped in water or held under an open faucet in an attempt to use the force of water to remove such matter. The wet razor is then shaken in order to further remove any matter caught in the razor during use. The razor is then stored for a certain period of time and reused.

Such methods, however, do not sufficiently remove the shaving matter and water remaining on the wet razor after use. This results in a contamination problem since microorganisms grow in the moist shaving matter caught in the razor during the storage period between each use. As such this is a source of infection to the user of the razor and also increases the extent of discomfort upon repeated reuse of the wet razor. That is, the degree of comfort decreases with each use as the shaving matter builds up, i.e. forms a film, interfering with the smooth functioning of the blades against the skin. This necessitates the user to frequently replace the otherwise good shaver with a new one which is not only expensive.

There is a known wet razor which includes a cleaning plate interposed between the upper and lower blades. When the user desires to clean away the matter caught in the wet razor after shaving, the cleaning plate is pushed forward from the head of the wet razor by the finger of the user so that the cleaning plate advances between the upper and lower blades to push out the matter lodged between the blades. However, the cleaning plate only partially removes the shaving matter between the cleaning plate and the blades and has little impact on drying the blades. Therefore, this wet razor fails to efficiently remove the shaving matter and does not overcome the above described problems of the prior art shavers.

Therefore, the present invention overcomes the above described problems which occur in the present wet razors.

An object of the present invention is to provide a wet razor which includes an integral device for effectively removing the shaving matter caught between the upper and lower blades and the area proximate the blades.

Another object of the present invention is to provide a wet razor which includes an integral device for effectively cleaning and drying the upper and lower blades.

A further object of the present invention is to provide a wet razor which aids is retarding the growth of microorganisms on the wet razor by enabling the blades and the surfaces proximate the blades to be first cleaned by removing shaving matter and then to be dried by removing water necessary for cleaning in the first step.

The preceding objects should be construed as merely presenting a few of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to both the summary of the invention and the detailed description, below, which describe the preferred embodiment in addition to the scope of the invention defined by the claims considered in conjunction with the accompanying drawings.

SUMMARY OF THE INVENTION

The wet razor of the present invention is defined by the claims with a specific embodiment shown in the attached drawings. For the purpose of summarizing the invention, the invention relates to a wet razor comprising a wet blade razor for removing shaving matter which accumulates during use and for drying the associated blades, comprising a cylindrical grip 1 with a first end 1A and a second end 1B and a chamber 1C formed in the grip and extending from the first end to the second end of the grip. A head 2 is positioned at the first end 1A of the grip 1 with a plurality of spray holes 4 formed in the head and with each the each spray hole 4 in air communication with the chamber 1C of the cylindrical grip 1 to permit, in use, air communication with air external the chamber of the wet razor. A piston 6 having a first and a second end is used. The piston has at least on duct 6A formed therethrough to permit air to flow through the piston and upon operatively positioning the piston into the chamber, i.e. in a manner where the piston slidably and sealingly engages the wall of the chamber, the chamber is divided into an upper chamber which is proximate the head and a lower chamber which is proximate the second end of the grip. As appreciated by one skilled in the art upon moving the piston within the chamber, the volume of the upper chamber and of the lower chamber change. A one-way valve means is positioned at the first end of the piston to permit air to flow only into the upper chamber through the piston. A push rod 9 has a first end and a second end. The second end of the piston is secured to the first end of the push rod 9 and perforations are formed in the push rod at the first end and at the second end. A cap is secured to the second end of the grip. An aperture is formed therein to permit the push rod to be sealably and slidably received therethrough. A blade assembly 7 is secured to the head. The blade assembly includes an upper blade 16 and a lower blade 17 with the blades being spaced apart and with the lower blade further including at least one aperture 14 formed therein to enable air communication with the space between the blades, the plurality of spray holes 4 and the upper chamber 15 such that after use shaving matter lodged in the space between the upper and lower blades is dislodged by immersing at least the blade assembly 13 in water while maintaining the second end of the grip in the air and moving the piston from the first end of the grip to the second end of the grip causing air in the lower chamber 14 to be compressed relative to air in the upper chamber 15 which causes the air in the ducts 6A to open the one-way valve permitting air in the lower chamber to move into the upper chamber and upon moving the piston 6 from the second end 1B toward the first end 1A of the grip, the air pressure increases in the upper chamber 15 which closes the one-way valve resulting in the air pressure in the upper chamber 15 to increase thereby forcing air out of the plurality of air spray holes 4 creating a plurality of bubbles in the water in which the blade assembly is immersed such that the bubbles are forced against the shaving matter dislodging it from the blade assembly 13. The one-way valve prevents shaving matter from being drawn into the spray holes when the piston is pulled back to the second end of the grip.

The blade assembly may further include an opening 15 formed beneath the lower blade to enable air communication with the opening and the upper chamber such that in use shaving matter lodged in the space between the upper and lower blades and beneath the lower blade may be dislodged.

The cap may be secured to the cylindrical grip in other ways, however the preferred method is to form threads at the second end of the grip, and to use a cap which includes threads formed thereon to enable the cap to threadably engage the threads of the cylindrical grip.

Preferably the one-way valve means includes a conical shaped opening formed in the first end of the piston. The first end of the push rod 9 further including a stop pin 8 terminating in a flange which partially protrudes into the upper chamber. A cone shaped plug 7 is used to seal the ducts 6A formed in the piston when the cone shaped plug is received into the cone shaped opening formed in the piston. That is, the cone shaped plug has an aperture formed therethrough to enable it to slide along the stop pin 8. Thus, in use the cone shaped plug can slide back toward the piston thereby closing off ducts 6A and the cone shaped plug can slide toward the flange thereby opening the ducts. The movement of the cone shaped plug is the result of air pressure which builds up in the upper and lower chambers. The sliding action of the cone shaped plug permits air to flow only into the upper chamber upon manipulation of the piston by the push rod 9 in the chamber.

The more pertinent and important features of the present invention have been outlined above in order that the detailed description of the invention which follows will be better understood and that the present contribution to the art can be fully appreciated. Additional features of the invention described hereinafter form the subject of the claims of the invention. Those skilled in the art can appreciate that the conception and the specific embodiments disclosed herein may be readily utilized as a basis for modifying or designing other structures for carrying out the same purposes of the present invention. Further, those skilled in the art can realize that such equivalent constructions do not depart from the spirit and scope of the invention as set forth in the claims.

BRIEF DESCRIPTION OF THE DRAWINGS

These and other objects, features and advantages of the present invention will become more apparent upon a reading of the following detailed specification and drawings, in which.

Similar reference characters refer to similar parts throughout the several views of the drawings.

DETAILED DESCRIPTION OF THE PREFERRED EMBODIMENTS

The invention will now be described in conjunction with the preferred embodiments by referring to the accompanying drawings.

Figure 1:
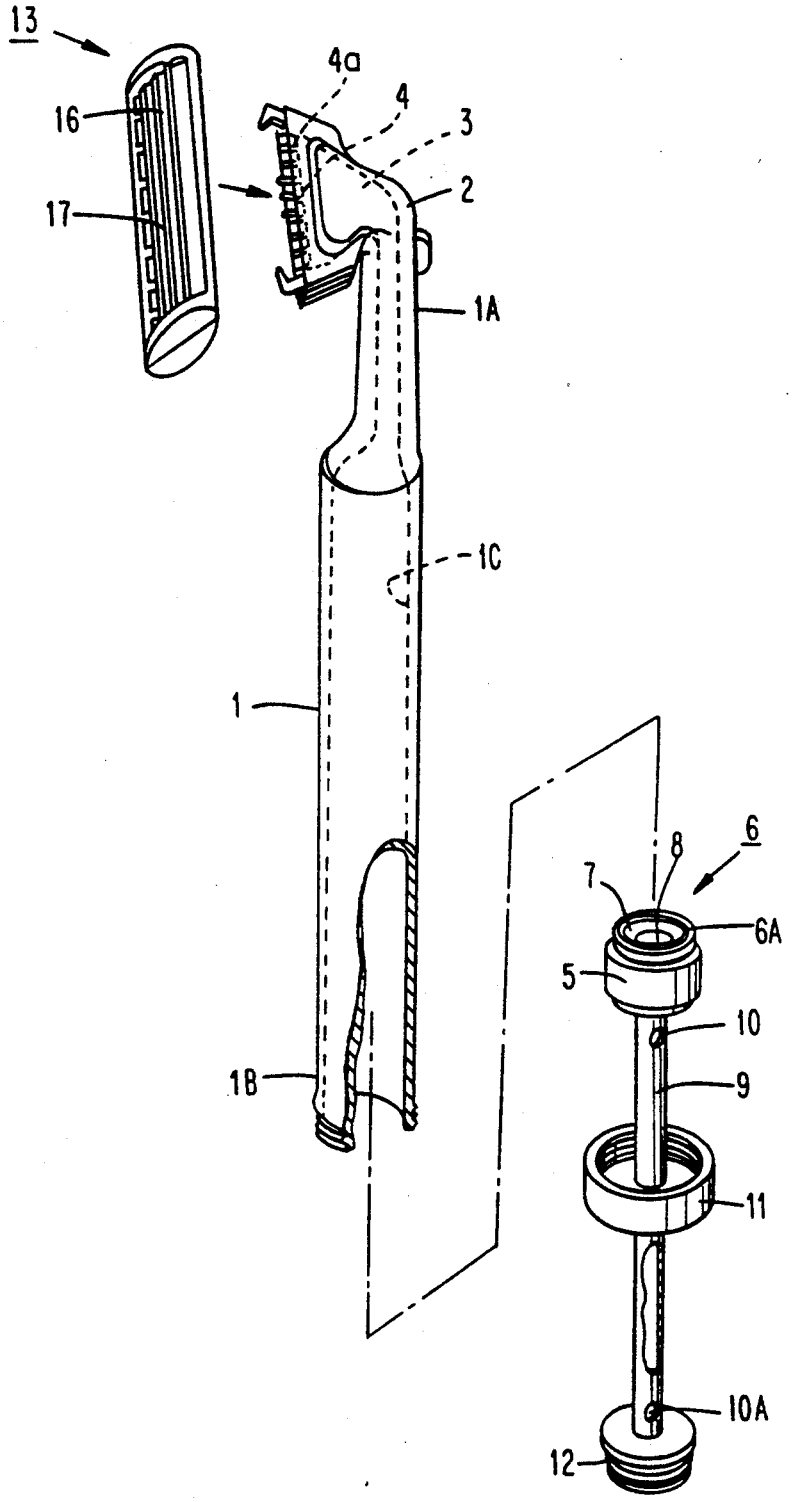
FIG. 1 is an exploded perspective view, partially broken away, of one embodiment according to the present invention.
Figure 2:
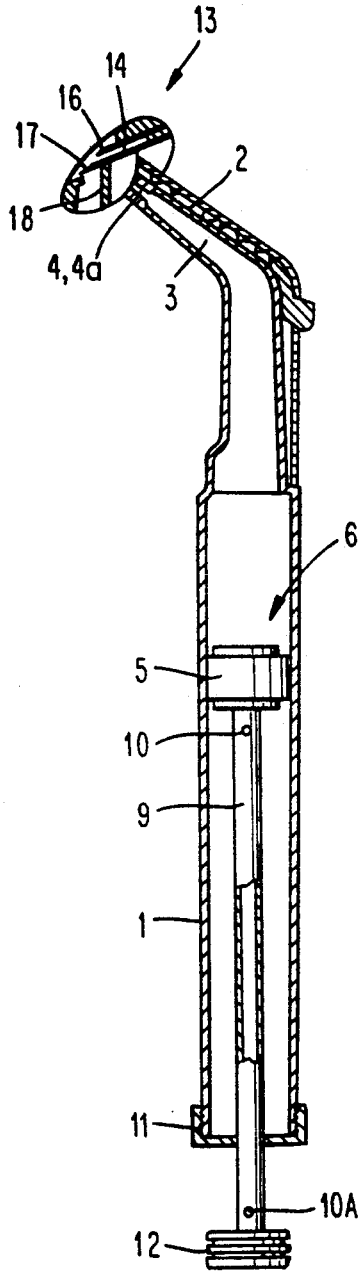
FIG. 2 is a sectional view of the assembled wet razor of FIG. 1.

FIG. 1 is an exploded view of the wet razor according to the present invention. As illustrated, the wet razor of the present invention comprises a cylindrical grip 1 with a chamber 1C formed therein. At the first end 1A of the cylindrical grip 1 a head 2 is secured. The head is angled to properly place the blades, in use, against the facial skin of the holder/user. The head 2 includes a duct 3 formed therein to enable air communication with the chamber 1C of the cylindrical grip 1. The head 2 is also provided with a plurality of air spray holes 4 formed in its front end 4*a* which are preferably spaced at regular intervals. The piston 6 is received into the chamber 1C of the cylindrical grip 1. A seal 5 is secured to the periphery 6A of the piston 6 to seal the piston against the wall of the chamber as it moves along the chamber 1C wall in a back and forth motion within the chamber 1C by the manipulation of the push rod 9.

Figure 3:
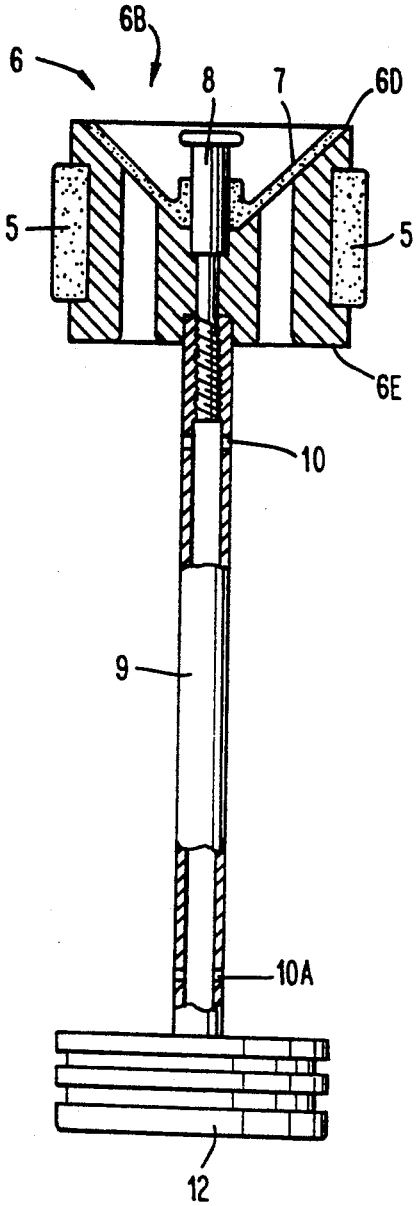
FIG. 3 is an enlarged sectional view of the piston and push rod of the present invention.

Referring to FIG. 3, the piston 6 includes a one-way valve 7. The one-way valve permits air to be drawn in through the at least one duct 6A formed in the piston 6 upon moving the piston 6 from a position proximate the head 2 to a position proximate the second end 1B of the cylindrical grip 1 and upon moving the piston 6 from the second end 1B to the first end 1A of the cylindrical grip 1, to force air out of the upper chamber 15 and through the plurality of air holes 4 and into the blade assembly 13 and ultimately the blades 16,17.

Figure 7A:
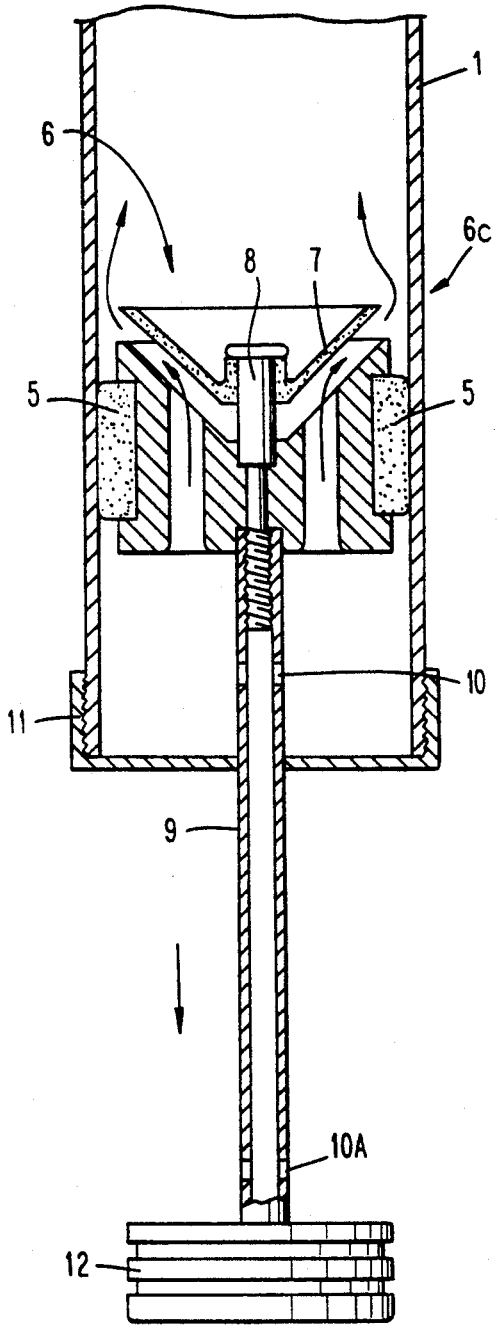
FIGS. 7(A)-7(B) are a sectional view showing the action of the pump by means of the piston and push rod according to the present invention.
Figure 7B:
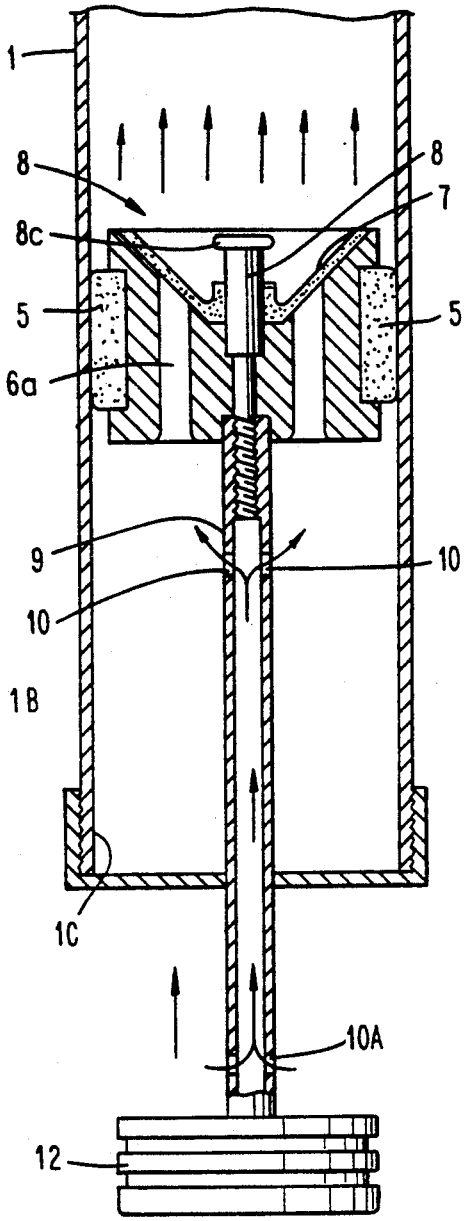

The piston preferably includes an opening 6B formed in the first end 6D with at least one duct 6A formed in the piston which extends from the second end 6E to the opening 6B formed in the piston 6 is preferably cone shaped, as illustrated in a sectional view at FIGS. 7A and 7B, with the one-way valve 7 being cone shaped so as to seal the ducts 6A when the cone is received by the cone shaped opening 6C during use. The cone includes an aperture formed therein so as to be slidably received on the stop pin 8 which has one end 8A securely mounted to the first end of the push rod 9. The opposite end 8B of the stop pin 8 includes a flange 8C which keeps the cone sliding off the stop pin 8 during use. That is, during use the cone slides back and forth along the length of the stop pin thereby opening and closing off ducts 6A. This permits air to only flow into the chamber when the push rod 9 moves the piston from the first end of the chamber to the second end of the chamber. The piston divides the chamber 1C into an upper chamber 15

(piston and head) and a lower chamber 14 (piston 6 and cap 11).

The lower end of the stop pin 8 is threadably secured to the first end of the push rod 9. The push rod 9 includes a channel formed along its length to enable air communication therethrough. Perforations are formed into the first and second ends of the push rod 9 to permit air flow into the first end of the push rod and out of the second end of the push rod during use. That is, a cap 11 is secured to the second end of the cylindrical grip 1. The cap 11 includes an opening formed therein to permit the push rod to be slidably received therethrough. The total area of the perforations is small in order to enable the one-way valve to be opened by the compressed air upon moving the piston toward the second end of the chamber.

In use when the push rod 9 moves the piston from the first end of the cylindrical grip 1 to the second end of the cylindrical grip, air flows from outside the shaver through the perforations 10A formed in the first end of the push rod into and along the channel and out of the perforations 10 formed in the second end of the push rod and into the lower chamber 14 of the grip 1. The air then moves through ducts 6A formed in the piston 6 thereby creating pressure against the cone forcing the cone to slide along the stop pin until stopped by the flange at the end of the stop pin. With the cone positioned against the flange, air flows through the ducts and into the upper chamber 15 from outside the shaver upon drawing the piston back toward the second end of the grip 1, as see FIG. 7A. In like manner, when forcing the piston from the second end of the grip to the first end of the grip, the air pressure increases within the chamber which forces the cone to slide back along the stop pin and against the openings of ducts 6A thereby preventing air from flowing back out through the ducts 6A, as see FIG. 7B.

The second end of the push rod 9 preferably includes a handle 12 to enable the push rod to be moved with relative ease.

Figure 4:
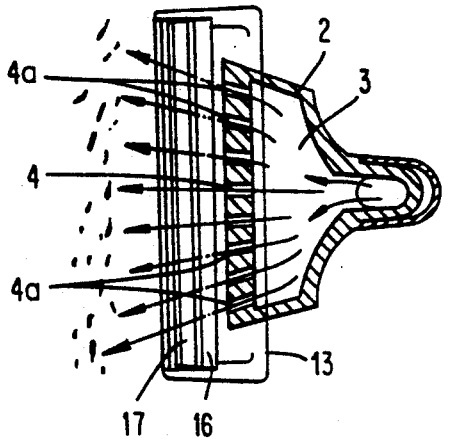
FIG. 4 is a plan sectional view of the head member of the wet razor of the present invention wherein the shaving matter is removed by the action of air pressure through the air spray holes formed in the front end of the head.

As illustrated in FIG. 4, the plurality of air spray holes 4 formed in head 2 direct air against the blade assembly 13 to promote removal of shaving matter from the blades and the area proximate the blades.

Figure 5:
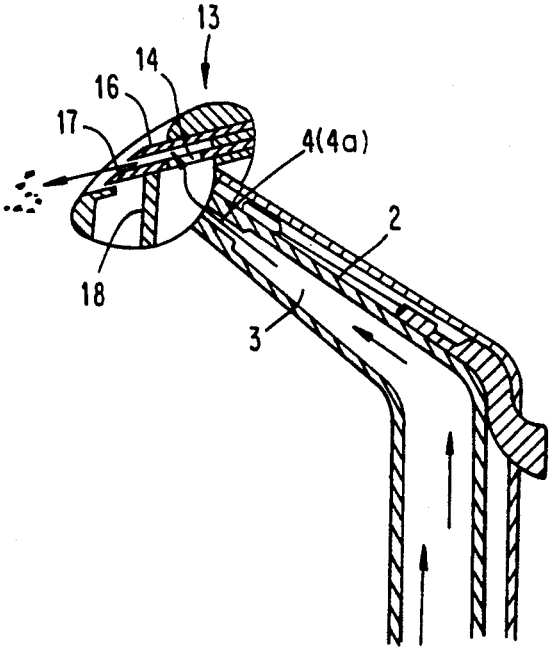
FIG. 5 is a side sectional view of FIG. 4.

The blade assembly 13 is secured to the head 2 and includes an upper blade 16 and a lower blade 17 with the blades being spaced apart and with the lower blade further including at least one aperture 14 formed therein, as see FIG. 5. This enables air communication with the space between the blades, the plurality of spray holes 4 and the upper chamber 15 of the grip 1 such that in use shaving matter lodged in the space between the upper and lower blades is dislodged by drawing air external the wet razor into the upper chamber 15 by moving the piston from the first end of the grip to the second end of the grip. Then upon moving the piston from the second end of the grip to the first end of the grip the shaving matter lodged in the space between the blades and proximate the blades is washed away by the air forced against the shaving matter lodged between the blades and proximate the blades upon moving the piston toward the head, i.e. toward the first end of the grip 1.

Figure 6:
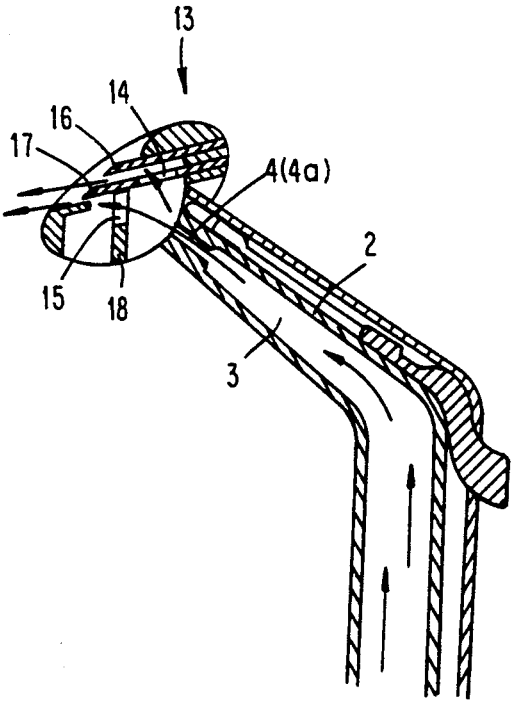
FIG. 6 is a sectional view of another embodiment of the wet razor according to the present invention.

As described above, the blade assembly 13, which is preferably separable from head 2, includes a blade 17 with the at least one aperture 14 formed therein, as shown in FIG. 5. However, the blade assembly 13 may further include a lower blade support member 18 which includes an aperture 15 formed therein to permit air communication between the underside of blade 17 and the upper chamber 15 of the grip 1 via the plurality of spray holes 4. This further enhances removal of shaving matter which is located underneath blade 17 and the area proximate it, as shown in FIG. 6. Accordingly, air may be jetted through the second air hole 15 to more perfectly and quickly remove shavings.

The use of the wet razor according to the invention as discussed above will be described in detail below.

FIGS. 7(A) and 7(B) illustrate the action of a pump by means of the piston 6 which reciprocates in the chamber 1C of the cylindrical grip 1 upon manual manipulation of the push rod 9 according to the present invention.

First, after the wet razor has been used, the blade assembly 13 and the head 2 are immersed in water. Then, the piston 6 is moved from the first end of the first end 1A to the second end 1B of the cylindrical grip 1, as shown in FIG. 7(A), causing air in the lower chamber 14 to be compressed relative to the air in the upper chamber 15 causing the air in the ducts 6A to forcibly slide the cone against the flange 8C permitting air in the lower chamber to move into the upper chamber. This step may also be performed with the head and blade assembly out of the water. Then the piston is proximate cap 11, the direction of movement of the piston is reversed, as see FIG. 7B. This step is to be performed with the blade assembly and head in the water as described above.

Upon moving the piston 6 from the second end 1B toward the first end 1A of the grip, the air pressure increases in the upper chamber 15 which forces the cone sealingly against the openings of the ducts 6. As the piston travels toward the first end of the grip 1, the air pressure in the lower chamber becomes lower relative to the air pressure external the shaver causing air to flow into the lower chamber 14 via perforations 10A, 10 and the channel of the push rod 9 thus permitting the piston to travel to the first end of the grip 1.

As the air pressure increases in the upper chamber 15, air is forced out of the plurality of air spray holes 4 creating a plurality of bubbles in the water in which the head is submersed. These bubbles are thus forced against the shaving matter to dislodge it from the blade assembly 13. While not being held to any particular theory of operation, it appears that as the bubbles are formed, broken and agglomerate together with the movement of the water created by such bubble action during movement of the piston toward the first end of the grip that the shaving matter is dislodged and washed away from the blade assembly by such action. That is, there is a combination of air and water action against the shaving matter lodged in the blade assembly causing the shaving matter to be dislodged therefrom. These steps may be repeated to even further enhance removal of the shaving matter, if necessary.

After the residual shaving matter between the blades is completely removed as described above, the razor is taken out of the water. Then, the piston is repeatedly reciprocated to generate pressurized air flow against the blades which completely remove the residual water in the blade assembly 13. This action properly prepares the shaver for storage by removing not only shaving matter but also water from the shaver, both of which foster bacterial growth. That is the blades are dried which aids in preventing blade deterioration by corrosion and microorganism growth reducing the need for frequent replacement compared to the prior art shavers.

Thus, even if the razor is stored and reused at a later time, it will give a more comfortable shave compared to a present day shaver which is improperly stored.

As apparent from the above description, the wet razor according to the present invention includes a washing or cleaning device for removing shaving matter and water remaining in the blade assembly after use, respectively. The wet razor also retards the growth of germs on the wet razor since the shaving matter which remains after use is cleaned away which is an advantage over the prior art wet razors. Accordingly, the wet razor is able to provide the user with more refreshing shaves especially upon reusing the shaver of the present invention. In addition, the wet razor may be preferred for environmental reasons.

Changes in the construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A wet blade razor for removing shaving matter accumulated during use and for drying the associated blades, comprising:

a cylindrical grip 1 with a first end 1A and a second end 1B and a chamber 1C formed in said grip and extending from said first end to said second end of said grip;

a head 2 positioned at said first end 1A of said grip 1 with a plurality of spray holes 4 formed in said head and with each said each spray hole 4 in air communication with said chamber 1C of said cylindrical grip 1 to permit in use air communication with air external said chamber of said wet razor;

a piston 6 having a first and a second end with at least one duct 6A formed therethrough such that upon operatively positioning said piston into said chamber, said chamber is divided into an upper chamber proximate said head and a lower chamber proximate said second end of said grip;

a one-way valve means positioned at said first end of said piston to permit air to flow only into said upper chamber through said piston;

a push rod 9 having a first end for securing said second end of said piston to said first end of said push rod 9 and a second end with a channel extending therebetween and with perforations formed in said push rod proximate said first and second ends;

a cap secured to said second end of said grip and with an aperture formed therein to permit said push rod to be slidably received therethrough; and a blade assembly 7 secured to said head and including an upper blade 16 and a lower blade 17 with said blades being spaced apart and with said lower blade further including at least one aperture 14 formed therein to enable air communication with said space between said blades, said plurality of spray holes 4 and said upper chamber 15 such that after use shaving matter lodged in said space between said upper and lower blades is dislodged by immersing at least said blade assembly 13 in water while maintaining said first end of said grip to said second end of said grip causing air in said lower chamber 14 to be compressed relative to air in said upper chamber 15 causing air in the ducts 6A open said one-way valve permitting air in said lower chamber to move into said upper chamber and upon moving said piston 6 from said second end 1B toward said first end 1A of said grip, the air pressure increases in said upper chamber 15 which closes said one-way valve resulting in the air pressure in said upper chamber 15 to increase thereby forcing air out of said plurality of air spray holes 4 creating a plurality of bubbles in the water in which said blade assembly is immersed such that said bubbles are forced against the shaving matter dislodging it from said blade assembly 13.

2. The wet razor of claim 1 wherein said cylindrical grip further includes threads formed at said lower end; and said cap includes threads formed thereon to enable in use said cap to threadably engage said threads of said cylindrical grip.

3. A wet razor comprising:

a cylindrical grip 1 with a first end 1A and a second end 1B and a chamber 1C formed in said grip and extending from said first end to said second end of said grip;

a head 2 positioned at said first end 1A of said grip 1 with a plurality of spray holes 4 formed in said head and with each said each spray hole 4 in air communication with said chamber 1C of said cylindrical grip 1 to permit in use air communication with air external said chamber of said wet razor;

a piston 6 having a first and a second end with at least one duct 6A formed therethrough to permit air communication through said piston and with a conical shaped opening formed in said first end of said piston and with a conical shaped opening formed in said first end of said piston and in use upon operatively positioning said piston into said chamber, said chamber is divided into an upper chamber proximate said head and a lower chamber proximate said second end of said grip;

a push rod 9 having a first end and a second end, with said first end securing said second end of said piston to said push rod 9 and with said first end further including a stop pin 8 terminating in a flange which partially protrudes into said upper chamber, with a channel extending between said first and second ends and with perforations formed in said push rod proximate said first and second ends;

a cone shaped plug 7 for sealing said ducts 6A when said cone shaped plug is received by said cone shaped opening formed in said piston;

said cone shaped plug having an aperture formed therein so as to be slidably received on said stop pin 8 to permit said cone shaped plug to slide back and forth along said stop pin thereby opening and closing off ducts 6A to permit air to flow only into said upper chamber upon manipulation of said piston by said push rod 9;

a cap secured to said second end of said grip and with an aperture formed therein to permit said push rod to be slidably received therethrough; and a blade assembly 7 secured to said head and including an upper blade 16 and a lower blade 17 with said blades being spaced apart and with said lower blade further including at least one aperture 14 formed therein to enable air communication with said space between said blades, said plurality of spray holes 4 and said upper chamber 15 such that after use shaving matter lodged in said space between said upper and lower blades is dislodged by immersing at least said blade assembly 13 in water while maintaining said second end of said grip in the air and moving said piston from said first end of said grip to said second end of said grip causing air in said lower chamber 14 to be compressed relative to air in said upper chamber 15 causing air in the ducts 6A to slide said cone shaped plug along said stop pin toward said flange thereby permitting air in said lower chamber to move into said upper chamber and upon moving said piston 6 from said second end 1B toward said first end 1A of said grip, the air pressure increases in said upper chamber 15 causing said cone shaped plug to slide along said stop pin away from said flange and seal said ducts resulting in the air pressure in said upper chamber 15 to increase thereby forcing air out of said plurality of air spray holes 4 creating a plurality of bubbles in the water in which said blade assembly is immersed such that said bubbles are forced against the shaving matter dislodging it from said blade assembly 13.

* * * * *